US011665782B2

(12) United States Patent
Henne et al.

(10) Patent No.: US 11,665,782 B2
(45) Date of Patent: May 30, 2023

(54) ASSEMBLY FOR SWITCHING A RESISTOR

(71) Applicant: Webasto SE, Stockdorf (DE)

(72) Inventors: Alexander Henne, Stockdorf (DE); Norbert Botzenmayer, Stockdorf (DE); Hans Rechberger, Stockdorf (DE); Heinz Seiler, Stockdorf (DE)

(73) Assignee: WEBASTO SE, Stockdorf (DE)

( * ) Notice: Subject to any disclaimer, the term of this patent is extended or adjusted under 35 U.S.C. 154(b) by 876 days.

(21) Appl. No.: 16/095,829

(22) PCT Filed: Apr. 28, 2017

(86) PCT No.: PCT/EP2017/060297
§ 371 (c)(1),
(2) Date: Oct. 23, 2018

(87) PCT Pub. No.: WO2017/186958
PCT Pub. Date: Nov. 2, 2017

(65) Prior Publication Data

US 2021/0227631 A1 Jul. 22, 2021

(30) Foreign Application Priority Data

Apr. 29, 2016 (DE) ..... 10 2016 108 005.5

(51) Int. Cl.
*H05B 1/02* (2006.01)

(52) U.S. Cl.
CPC ..... *H05B 1/0202* (2013.01); *H05B 1/0236* (2013.01); *H05B 2203/035* (2013.01)

(58) Field of Classification Search
CPC ..... H05B 1/0202; H05B 1/02; H05B 1/0236; H05B 2203/035; H05B 3/0019; H05B 3/0023
(Continued)

(56) References Cited

U.S. PATENT DOCUMENTS 3,708,696 A * 1/1973 Lorenz ..... G05D 23/1909 327/452
3,780,263 A * 12/1973 Kuzyk ..... G05D 23/24 219/501
(Continued)

FOREIGN PATENT DOCUMENTS

DE 102011007817 A1 10/2012
DE 202012013008 U1 6/2014

OTHER PUBLICATIONS

PCT International Search Report and Written Opinion, PCT/EP2017/060297, dated Jul. 12, 2017, 24 pages.

*Primary Examiner* — Justin C Dodson
(74) *Attorney, Agent, or Firm* — Quarles & Brady LLP

(57) ABSTRACT

An assembly, comprising a heat-dissipating first resistor, control device for controlling the first resistor, as well as a grounded component, which lies on a potential without direct relation to a control voltage.

The first resistor is arranged in spatial vicinity of the grounded component and comprising a first and a second connection.

The control device comprises a first switching device and a second switching device.

The first switching device, first resistor and second switching device form a series connection.

A compensation device is configured such that in the On-state of the first resistor a voltage is applied between the first and second connection, wherein the resistor in the off-state is held on an in-between potential that lies between the first and the second potential and/or the control device is configured to trigger the first resistor in a pulse width modulated fashion, such that the first as well as the second switching device are switched synchronously.

16 Claims, 4 Drawing Sheets

(58) Field of Classification Search
USPC ..... 219/505, 483–486, 507, 494, 497
See application file for complete search history.

(56) References Cited

U.S. PATENT DOCUMENTS 4,048,513 A * 9/1977 Frost ..... H05B 3/0019 307/28
4,121,092 A * 10/1978 Undin ..... G05F 1/66 219/241
5,105,067 A * 4/1992 Brekkestran ..... G05D 23/2401 2/69
5,731,690 A * 3/1998 Taniquchi ..... H02K 19/34 322/28
6,121,569 A * 9/2000 Miley ..... F03H 1/00 219/121.48
9,791,173 B2 * 10/2017 Chen ..... F24H 9/2071
2001/0020615 A1 * 9/2001 Bradenbaugh ..... H05B 1/0283 219/497
2001/0045733 A1 11/2001 Stanley et al.
2005/0205549 A1 * 9/2005 Crawford ..... H05B 1/0288 219/494
2010/0038351 A1 * 2/2010 Tabaczynski ..... B60L 1/08 219/202
2013/0025494 A1 * 1/2013 Tarnow ..... H02H 9/08 105/35
2013/0172964 A1 * 7/2013 Mills ..... A61F 7/08 607/96

* cited by examiner

ASSEMBLY FOR SWITCHING A RESISTOR

CROSS-REFERENCE TO RELATED APPLICATIONS

This application represents the national stage entry of PCT International Application No. PCT/EP2017/060297 filed on Apr. 28, 2017, and claims priority to German Patent Application No. 10 2016 108 005.5 filed on Apr. 29, 2016. The contents of these applications are hereby incorporated by reference as if set forth in their entirety herein.

The invention relates to an arrangement comprising a heat-emitting first resistor, a control device for switching the first resistor, and an (in particular grounded) component that is at a potential without direct reference to a driving voltage, in particular a housing and/or chassis component, wherein the first resistor is arranged in the spatial vicinity of the component, in particular housing or chassis component, as claimed in claim 1, and to a corresponding control method as claimed in claim 10.

FIG. 1 illustrates the prior art and shows a resistor that is situated in the vicinity of a housing and is depicted symbolically by the resistors R1 to R4. The resistor is cooled in order to dissipate heat at the housing.

The capacitors C1 to C5 correspond to a symbolic depiction of a capacitance that is associated with the resistor and is caused by the spatially close connection of the resistor to the housing.

The transistor M switches the resistor (R1 to R4) on and off. If the transistor M is switched off, the entire resistor (R1 to R4) is at the supply voltage. If the transistor M is then switched on, the voltage across the resistor (R1 to R4) changes. A lower end (in FIG. 1) of R4 goes toward 0 V, whereas an upper end (in FIG. 1) of R1 remains at the supply voltage. The middle voltage, that is to say between a lower end (in FIG. 1) of R2 and an upper end (in FIG. 1) of R3 of the complete resistor (R1 to R4), corresponds to half the supply voltage.

The result of this is that the capacitor (C1 to C5) in this schematic example is entirely or at least partly discharged. C1 is for example "completely" discharged, whereas C3 is discharged to half the supply voltage. On average, the result of this is that the entire capacitor is discharged by half the supply voltage.

If the transistor M is switched off, this phenomenon is repeated in principle. The capacitors are in this case not discharged, but rather charged (up to the supply voltage).

The described charging and discharging of the capacitors may lead to significant electromagnetic interference (both to line-conducted interference and to radiated interference) depending on the speed.

In particular if the resistor (R1 to R4) is switched rapidly (and has a distributed capacitance to ground), interference may occur on a housing and/or a cable shield and/or grounding lines. Conventional countermeasures are:

- A shield, so that the resistor no longer couples to ground potential,
- Filter components (common-mode chokes, Y-capacitors),
- Slowing of the clocking (switching frequency, switching time).

A shield is however not possible in all cases, or is often only able to be integrated at considerable extra cost. A shield additionally has the effect that possible thermal coupling is worsened, as both a shielding layer and at least one further insulation layer are required.

Depending on the application (with respect to voltage and current), filter components may become comparatively expensive, heavy and bulky.

Slowing the clocking (switching time) is often undesirable as the clocking is adjusted accordingly to other requirements.

It is therefore an object of the present invention to propose an arrangement comprising a heat-emitting first resistor, a control device for switching the first resistor, and an (in particular grounded) component that is at a potential without direct reference to a driving voltage, in particular a housing and/or chassis component, wherein the first resistor is arranged in the spatial vicinity of the component, in particular housing or chassis component, wherein interference caused by the switching on and switching off of the resistor and/or caused by pulse width modulation is intended to be reduced in a simple manner.

Furthermore, it is an object of the invention to propose a corresponding control method.

This object is achieved by means of the features of claim 1.

The object is achieved in particular by an arrangement comprising a heat-emitting first resistor, a control device for switching the first resistor, and an (in particular grounded) component that is preferably at a potential without (direct) reference to a driving voltage, in particular a housing and/or chassis component, wherein the first resistor is arranged in the spatial vicinity of the component, in particular housing or chassis component, and has a first and a second terminal, wherein the control device comprises a first switching device and a second switching device, wherein the first switching device, the first resistor and the second switching device are connected in series in said order and thus form a series circuit. According to a first preferred aspect of the invention, a compensation apparatus is provided and configured such that, in the on state of the first resistor, a voltage is present between the first and the second terminal, such that the first terminal is at a first potential and the second terminal is at a second potential, wherein the first resistor in the off state is kept at an intermediate potential that lies between the first and the second potential, in particular is kept at at least approximately half the supply voltage. The first resistor is generally a resistor that couples to an external potential. According to a second preferred aspect of the invention (as an alternative or in addition to the first preferred aspect), the control device is configured to drive the first resistor using pulse width modulation, wherein the first and the second switching device are switched synchronously.

A core concept of the first aspect of the invention is that the (first) resistor is kept at an intermediate potential in the off state, which intermediate potential lies between the first and the second potential. A voltage corresponding to the intermediate potential may correspond for example to 30 to 70, preferably 45 to 55, even more preferably 48 to 52, even more preferably to (at least approximately) 50% of the voltage that is present at the first terminal of the (first) resistor in the on state (which is generally the "supply voltage"). By way of the compensation apparatus according to the invention, currents that are generated by capacitances between the (first) resistor and the housing at least partly (and ideally completely) compensate one another. In the case of (synchronous) in particular initial switching on of the two switching devices, a current flowing in a capacitor that corresponds to a resistor section that lies comparatively close to the first switching device is taken up by a capacitor that corresponds to a resistor section that lies comparatively close to the second switching device. Similar statements apply to further capacitors or capacitor portions that correspond to corresponding (mirror-image) resistor sections. Ideally, current no longer flows via a ground connection. The same (in the reverse direction) is made possible if the two switching devices are switched off synchronously.

A core concept of the second aspect of the invention is that the resistor is driven using pulse width modulation, but not by way of only one switching device, but rather synchronously (at the same time) by way of the two switching devices. In this context, the compensation apparatus (having the resistors described further below and the connecting line described further below) may then possibly be dispensed with (or is only optional). This compensation apparatus plays a role essentially only when the switching devices are started up or initially switched on, and is then able in particular to reduce EMC interference. In the case of PWM driving or subsequent switching processes during operation (for example with a continuous heating current if the resistor is a heating resistor), the compensation apparatus no longer plays a role (or, if it is provided, at best plays a minor role), as it is then effectively possible to achieve an identical or at least similar effect by way of (virtually) synchronous switching of the two switching devices (instead of just one switching device). Ultimately, as a result of the two switching devices on both sides of the resistor (in particular heating resistor), the full voltage swing is also not present during PWM operation in the case of PWM switching, but rather a smaller voltage swing (in particular at least approximately only half).

The above compensation apparatus thus has in particular the advantage that, when the resistor (heating resistor) is initially switched on (started up) or finally switched off (shut down), a single pulse at this time is compensated or at least minimized. To compensate interference during operation (that is to say during PWM driving), such a compensation apparatus (having the resistors described further below and the connecting line) is not absolutely necessary. To this end, it is provided according to the invention (according to the second aspect) that the control device is configured such that the two switching devices are able to be switched synchronously (in particular at the same time).

Fundamentally, a distinction has to be drawn between switching on the resistor (that is to say a change from the off state to the on state or switching off the resistor, that is to say a change from the on state to the off state) and switching the switching devices. In this context, switching on the resistor (in particular heating resistor) should be understood in particular as initial starting up (after a relatively long pause of for example at least 10 seconds or at least one minute). Switching off should accordingly be understood in particular as final (for at least a period of 10 seconds or at least one minute) shutting down of the resistor (or disconnection of the resistor from the power source). Even in the case of PWM driving, there are extremely short interruptions (separated by the individual pulses) in the supply. During these very short interruptions, the resistor (in particular heating resistor) is however still in the on state. In other words, the first or second switching device may thus be switched off in an on state of the resistor (that is to say block a current). With respect to the switching devices, a distinction should be drawn between a switched-on time (that is to say a time during which the switching device does not block current) and a switched-off time (that is to say a time during which the switching device blocks the current). If, in the case of the switching devices, reference is made to the time when the resistor is put into service, reference should be made in particular to "initial" switching on of the respective switching device. If, in the case of the switching devices, reference is made to the shutting down of the resistor, reference should made to "final" switching off of the switching devices. In this case too, initial switching on should be understood in particular as switching on after an interruption of at least 10 seconds or at least one minute. In the same way, final switching off should mean an interruption in the operation of the resistor (heating resistor) of at least 10 seconds, preferably at least one minute.

A "spatial vicinity" between the (first) resistor and the component (e.g. housing) should be understood in particular as a (minimum) spacing of less than 1 cm, in particular less than 0.5 cm, between the resistor and the component. The "minimum spacing" is the smallest spacing if a spacing between the resistor and the component (spatially, that is to say along an extent of an intermediate space) is not constant. The resistor and the component should be spaced apart from one another, however, to an extent such that no short circuit is formed between the resistor and the housing. The (first) resistor is preferably the resistor of an electrical heating apparatus, in particular an electrical layer heating apparatus. Electric layer heating apparatuses comprise a heating resistor that extends over an area and heats up when an electric current passes through it. The resistor is generally a resistor that is arranged in the spatial vicinity of an (in particular grounded) component, which is preferably at a potential without direct reference to a driving voltage, in particular to a housing and/or a chassis component, in order to dissipate heat. The resistor may generally be a heating resistor, that is to say that component by way of which heat is generated in a heating apparatus for heating purposes, or another resistor that may have to be cooled.

In one embodiment, the control device comprises a (high-resistance) second resistor, a (high-resistance) third resistor and a connecting line, wherein the second and third resistor are connected in series with one another and are connected in parallel with the series circuit formed of the first switching device, the first resistor and the second switching device, wherein the connecting line connects a point between the second and the third resistor to a point between the two switching devices. In the case of such a structure, it is easily possible to set the desired intermediate potential (in particular the mid-voltage). A high-resistance resistor should be understood to mean a resistor whose resistance is considerably higher than the resistance of the first resistor (e.g. at least twice or at least five times as high). By way of example, the resistance of a (high-resistance) resistor may be at least 1 KΩ, preferably at least 1 MΩ.

As an alternative or in addition to the second and third resistor, the compensation apparatus may have active circuitry whose effect is that a corresponding voltage (in particular a mid-voltage) is able to be set at the first resistor.

A resistance of the second resistor and a resistance of the third resistor differ by at most 10%. More preferably, the resistances of the second and third resistor are (at least substantially) the same. The difference (of at most 10%) should be calculated in such a way that a difference in the resistances is first of all formed and this difference is divided by the smaller resistance (and then multiplied by 100 to arrive at a percentage). In particular if the resistors are substantially (or at least substantially) the same, interference such as described above may be significantly reduced or ideally even completely avoided.

The abovementioned connecting line may be connected for example (roughly) in the middle of the first resistor. However, it is also conceivable (as a deviation from this) to connect the connecting line to another point (between the first and the second switching device), for example to (or near) the first switching device or the second switching device, or else to several points.

The first and/or the second switching device is/are preferably configured as a transistor, in particular a MOSFET or IGBT, or comprise(s) such a transistor (MOSFET or IGBT), preferably based on silicon or silicon carbide or gallium arsenide. As a result, a structure is provided that is able to be switched rapidly and reliably.

The arrangement according to the first aspect preferably comprises a control apparatus that is configured to switch the first and the second switching device synchronously (at the same time). Fundamentally, however, the (preferably synchronous) switching may also be provided by another component that is not necessarily part of the arrangement. In this respect, the arrangement according to the first aspect is fundamentally distinguished above all (from an electrical point of view) in that a structure is provided that easily enables corresponding compensation (in the case of preferably synchronous switching).

There is preferably provision for a support apparatus, in particular comprising one or more capacitors, for example in parallel with the second and/or third resistor, for supporting a voltage (in particular mid-voltage) corresponding to the intermediate potential. If the first and the second switching device are not able to be switched on "100%" synchronously, this leads, depending on the switching time and time difference, to a differing current that flows via a ground connection. The support apparatus (in particular capacitors) are then able to support the desired voltage (mid-voltage) in order to alleviate the effect of the time difference. In the simplest case, capacitors are connected in parallel with the second and third (high-resistance) resistor.

A microcontroller and/or FPGA may furthermore be provided. An FPGA (field programmable gate array) is an integrated circuit (in which a logic circuit is able to be programmed). Microcontrollers or FPGAs are provided in order to control the switching of the first and/or second switching device, in particular in order to hone a switching time of the first and second switching device. As a result of this as well, difficulties in terms of timing (switching time) of the two switching devices (in particular transistors or MOSFETs or IGBTs, preferably based on silicon or silicon carbide or gallium arsenide) are able to be alleviated significantly, as a result of this timing being honed in order to achieve a degree of synchronicity that is as high as possible. Effective compensation is thereby able to be achieved.

The arrangement may furthermore comprise a current source, in particular a DC current source. Such a current source may however also be provided externally, such that the arrangement just has corresponding terminals for connecting a current source.

A time lag between a switch-on time of the first switching device and a switch-on time of the second switching device is preferably less than 20%, preferably less than 5% of a switched-on time of the first switching device. As an alternative or in addition, a time lag between a switch-off time of the first switching device and a switch-off time of the second switching device is less than 20%, preferably less than 5% of a switched-on time of the first switching device.

A clock rate (frequency) of the PWM driving is preferably in a range of 1 kHz to 30 kHz, more preferably of 8 kHz to 25 kHz. A pulse width (duty cycle) of the PWM driving is preferably in the range of 1% to 100% of a cycle.

The abovementioned object is furthermore achieved by a control method, in particular using the above arrangement, for switching a heat-emitting first resistor having a first and a second terminal and arranged in the spatial vicinity of an (in particular grounded) component, which is preferably at a potential without (direct) reference to a driving voltage, in particular to a housing and/or chassis component. According to a first preferred aspect of the method, the first terminal in an on state of the first resistor is at a first potential and the second terminal in an on state is at a second potential, wherein the resistor in an off state is kept at an intermediate potential, which lies between the first and the second potential, in particular is kept at at least approximately half the supply voltage. According to a second preferred aspect of the method, the (first) resistor (in particular heating resistor) is driven using pulse width modulation, wherein a first switching device associated with the first terminal and a second switching device associated with the second terminal are switched synchronously.

Preferably, also in the first aspect of the method, a first switching device associated with the first terminal and a second switching device associated with the second terminal are switched synchronously (in particular at the same time), at least upon the initial switching on and final switching off.

A time lag between a switch-on time of the first switching device and a switch-on time of the second switching device is preferably less than 20%, preferably less than 5% of a switched-on time of the first switching device. As an alternative or in addition, a time lag between a switch-off time of the first switching device and a switch-off time of the second switching device is less than 20%, preferably less than 5% of a switched-on time of the first switching device.

The abovementioned object is furthermore achieved by an electrical heating apparatus, in particular a layer heating apparatus, comprising an arrangement of the type described above and/or configured to perform the control method described above. With regard to the advantages of the electrical heating apparatus and of the control method, reference is made to the statements made with respect to the arrangement described above. The electrical heating apparatus may also comprise a (clocked) heating wire or a PCT element as heating element.

The electric layer heater may comprise a heating layer that forms an electrical resistor and is heated by the flow of a current through the heating layer, such that heat is able to be emitted for heating purposes.

The heating layer (heating coating) may be applied for example in a plasma coating process, in particular plasma spraying, or in a screen-printing process or as a resistance paste, in particular to the insulating layer. In the plasma coating process, it is for example firstly possible for an electrically conductive layer to be applied, in particular to the insulating layer. Regions may subsequently be cut out of the electrically conductive layer, such that a conductor track or multiple conductor tracks is/are left behind. Use is however preferably made of a masking technique. The conductor tracks may then form the heating resistor or multiple heating resistors. As an alternative to a masking technique, said regions may for example be cut out of the conductive layer by means of a laser. The heating coating may for example be a metal layer and possibly comprise nickel and/or chromium, or be composed of said materials. For example, use may be made of 70-90% nickel and 10-30% chromium, wherein a ratio of 80% nickel and 20% chromium is considered to be highly suitable.

The heating coating may for example cover an area of at least 5 $cm^2$, preferably at least 10 $cm^2$ and/or at most 200 $cm^2$, preferably at most 100 $cm^2$.

The heating coating preferably has a height (thickness) of at least 5 μm, preferably at least 10 μm and/or at most 1 mm, preferably at most 500 μm, even more preferably at most 30 μm, even more preferably at most 20 μm. A conductor track defined by the heating coating may be at least 1 mm, preferably at least 3 mm, even more preferably at least 5 mm, even more preferably at least 10 mm, even more preferably at least 30 mm wide. The expression "width" should be understood to mean the extent of the conductor track perpendicular to its longitudinal extent (which normally also defines the direction of the current flow).

The arrangement according to the invention (and in particular a heating coating that may be provided) may be designed for operation in the low-voltage range, preferably for 12 volts, 24 volts or 48 volts. The "low-voltage range" should preferably be understood to mean an operating voltage of lower than 100 volts, in particular lower than 60 volts (DC current). The arrangement according to the invention (and in particular a heating coating that may be provided) is preferably designed for operation in the high-voltage range, preferably for above 100 V volts or above 250 V or above 500 V, for example in a range of 250-800 V. In a higher voltage range, the abovementioned effects to be avoided are particularly pronounced in the prior art. In general, the arrangement, and in particular a heating coating that may be provided, is designed for operation with DC current.

The layer heater or heating coating may fundamentally be configured as described in WO 2013/186106 A1 and/or WO 2013/030048 A1. Said documents describe heaters that have an electric heating layer that warms when an electrical voltage is applied (or when a current flows).

The resistors already mentioned may fundamentally be manufactured from any desired electrically conductive material, but are preferably made of metal.

The arrangement according to the invention and/or the method according to the invention and in particular the electrical heating apparatus are preferably intended for use in a vehicle, in particular a motor vehicle, and/or are configured accordingly.

Further embodiments emerge from the subclaims.

The invention will be described below with reference to an example according to the prior art and a first exemplary embodiment, these being explained in more detail with reference to the drawings. In the figures.

In the following description, the same reference designations will be used for identical parts and parts of identical action.

Figure 1:
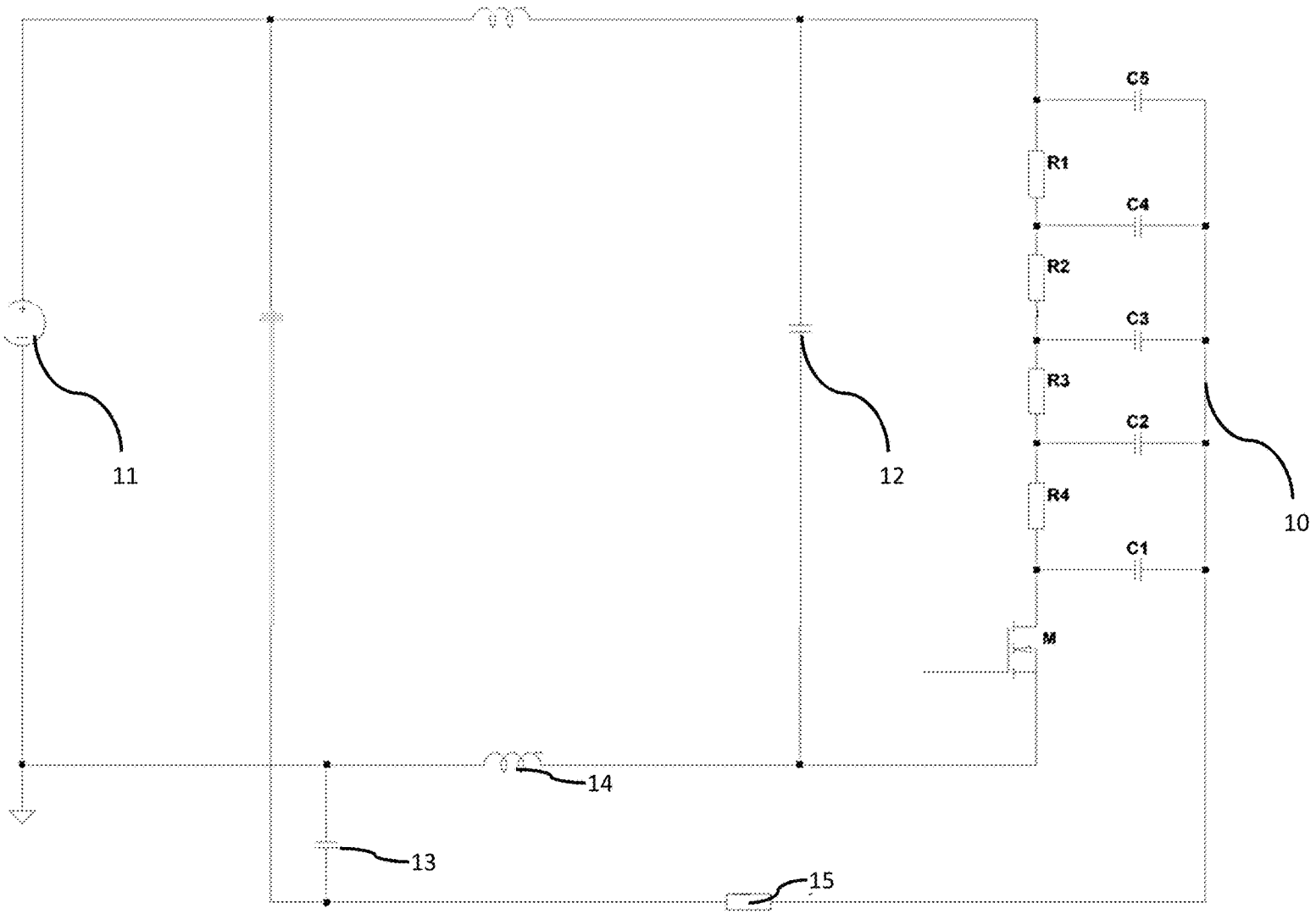
Fig. 1 Prior Art
FIG. 1 shows an arrangement for supplying power to and switching a resistor arranged in the vicinity of a housing, according to the prior art.

FIG. 1 shows a schematic view of an arrangement having an electrical resistor that is to be switched, according to the prior art. The electrical resistor to be switched is in this case depicted symbolically by the resistors R1 to R4. Fundamentally, however, what is involved in this case is just one (continuous) resistor. To this extent, the schematically depicted resistors R1 to R4 may also be understood as resistor sections of the resistor (that is to say individual sections of the resistor that are connected in series). As an alternative, however, resistors that are structurally delimited from one another (for example four of them) may also actually be involved. The resistor R1 to R4 is arranged close to a housing 10 for heat extraction (cooling) purposes.

The capacitors C1 to C5 shown in FIG. 1 correspond to a symbolic depiction of a capacitance of the resistor that results from the close arrangement to the housing. In the sectional view of the resistor R1 to R4 having four sections R1, R2, R3 and R4, these capacitances may then be assigned to individual sections.

Furthermore, a switch M (specifically a transistor, in particular MOSFET or IGBT) is provided, which is able to be switched on and off. If the switch M is switched off, the resistor R1 to R4 is at the supply voltage, which is provided by a voltage supply 11. If the switch M is then (initially) switched on, the voltage across the resistor R1 to R4 changes. The lower end (in FIG. 1) of R1 goes toward 0 V, whereas the upper end (in FIG. 1) of R1 remains at the supply voltage. The result of this is that the capacitor, according to the schematic depiction C1 to C5, is entirely or partly discharged. The capacitor C1 is for example completely discharged, whereas C3 is discharged to half the supply voltage. Half the supply voltage corresponds to the middle voltage across the whole resistor.

On average, the complete capacitance is discharged by half the supply voltage.

If the switch M is then (finally) switched off, the process just described is basically repeated. However, the capacitors are not discharged, but rather charged up to the supply voltage. This charging and discharging of the capacitors C1 to C5 may lead to significant EMC interference (both line-conducted and radiated) depending on the speed of the switching.

The reference sign 12 denotes an intermediate circuit capacitor. Further capacitors 13 and inductors 14 form part of a line impedance stabilization network (LISN) and are not of further importance for the present invention. The reference sign 15 symbolizes a ground connection of the housing 10.

Figure 2:
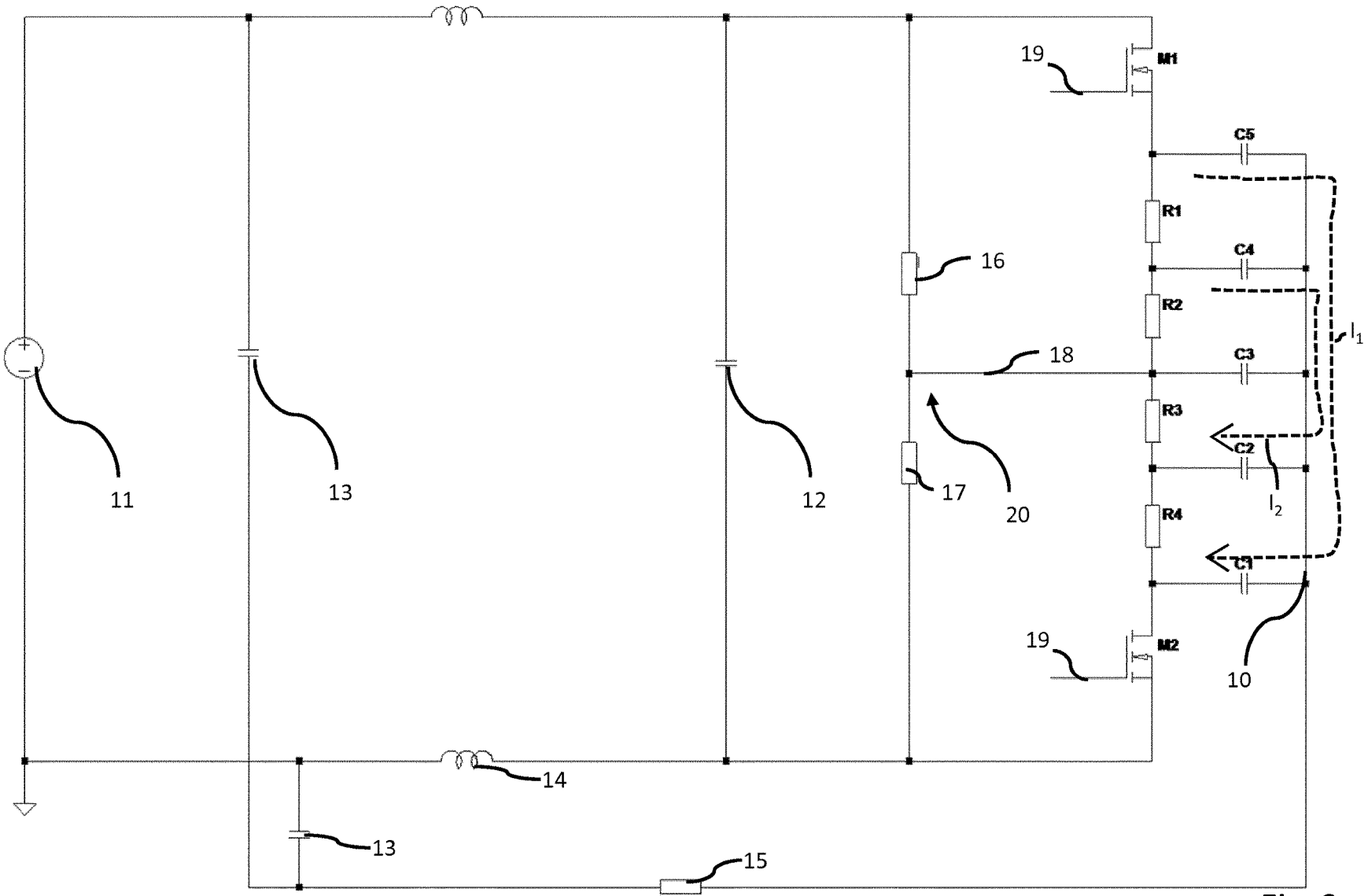
FIG. 2 shows an arrangement for supplying power to and switching a resistor arranged in the vicinity of a housing, according to a first exemplary embodiment of the invention during a first switching process.

FIG. 2 shows an arrangement analogous to FIG. 1, but with differences according to the invention. The elements/units having the reference signs 10 to 15 correspond to the arrangement according to the prior art according to FIG. 1, such that, in this respect, reference is made to the statements made with respect to the prior art.

In contrast to the prior art, the arrangement according to FIG. 2, however, comprises not just one switch M (cf. FIG. 1), but rather two switches M1, M2 (which are configured as transistors, preferably MOSFETs or IGBTs). Furthermore, two (high-resistance) resistors 16, 17 are provided, which are connected to the first resistor R1 to R4 by way of a connecting line 18.

Specifically, the first switching devices M1, the first resistor R1 to R4 and the second switching device M2 are connected in series. The second (high-resistance) resistor 16 and the third (high-resistance) resistor 17 are connected in parallel therewith. The connecting line 18 is connected between the (high-resistance) resistors 16, 17, on the one hand, and to the resistor R1 to R4, on the other hand. Specifically, the connecting line may be connected between a second resistor section R2 and a third resistor section R3 (in the sectional view). However, this is not mandatory. The connecting line could also for example (in FIG. 2) be arranged above R1 or below R3, etc.

I1 and I2 symbolize currents that flow when the switches M1 and M2 are switched on.

The two (high-resistance) resistors 16, 17 have the same value in the present exemplary embodiment (but may also possibly vary, at least slightly). The switches M1, M2 are switched synchronously (at the same time).

Figure 3:
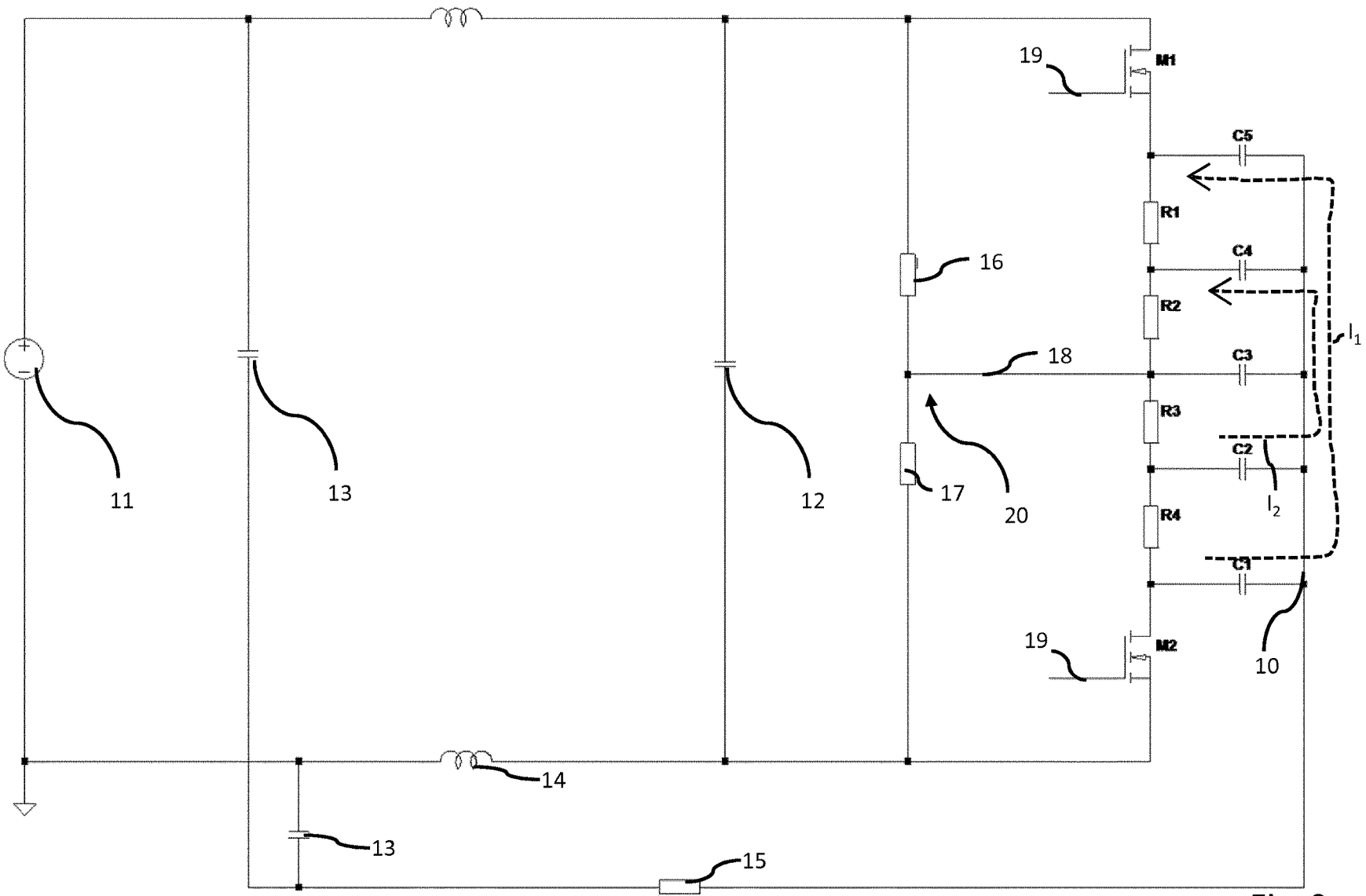
FIG. 3 shows an arrangement according to FIG. 2 during a second switching process.

When M1 and M2 are switched on synchronously (in particular initially), the current flowing in C5 is (directly) taken up by C1. The same applies for C4 and C2. Ideally, current then no longer flows via the ground connection. In principle, the same occurs (in the reverse direction) if M1 and M2 are switched off synchronously. This is illustrated in FIG. 3. FIG. 3 corresponds to FIG. 2, only in that the currents I1 and I2 that flow upon switching off are shown.

If the switching devices M1 and M2 are not switched on (exactly) synchronously, depending on the switching time and time difference, a particular current flows via the ground connection 15. Even when the switching devices M1 and M2 do not switch (exactly) synchronously, the undesired current is however able to be reduced by at least a factor of 10 (in comparison with the driving according to FIG. 1). Capacitors may also possibly support the mid-voltage that is present at the resistor R1 to R4 in the switched-off state of the switching devices M1 and M2, so as to mitigate the effect of the time difference. These capacitors may for example be arranged in parallel with the two (high-resistance) resistors 16, 17.

The switching devices M1, M2 are controlled by a control apparatus 19 (not shown in detail). The (high-resistance) resistors 16, 17 and the connecting line 18 are elements of a compensation apparatus 20, which ensures (as described above) that a mid-voltage is present at the resistor R1 to R4 in the (finally) switched-off state of the switching devices M1, M2.

A (fast) control unit, such as for example a microcontroller or FPGA, may also possibly hone the switching time (timing) of the two switching devices (MOSFETs) M1 and M2, so as to achieve a comparatively high degree of synchronicity.

Figure 4:
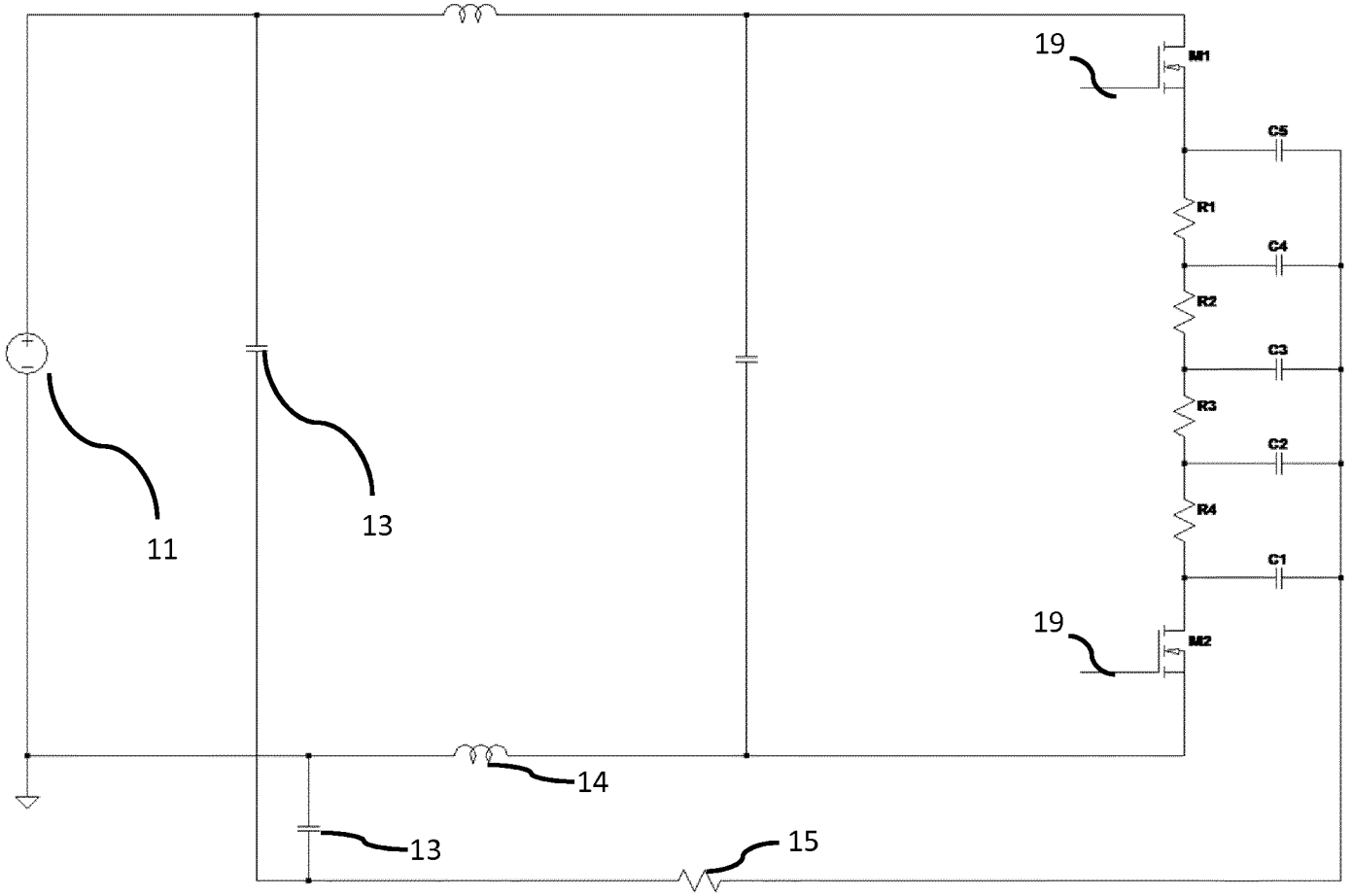
FIG. 4 shows an arrangement for switching the supply of power to a resistor arranged in the vicinity of a housing, according to a second exemplary embodiment of the invention.

FIG. 4 shows an alternative embodiment of the invention. This corresponds to the embodiment according to FIGS. 2 and 3, with the difference that the compensation apparatus (with the resistors 16, 17 and the connecting line 18) is not provided. In this embodiment, the resistor R1-R4 is driven using PWM. In this case, the switching devices are switched synchronously not only upon initial switching on and upon initial switching off, but also during operation of the resistor R1-R4 (that is to say during the on state of the resistor). As a result, interference during the PWM driving of the resistor (in particular heating resistor) during operation is able to be compensated or at least reduced. In the first embodiment according to FIGS. 2-3 as well, PWM driving of the resistor R1-R4 takes place take place (in particular as described with reference to FIG. 4).

It is pointed out at this juncture that all of the above-described parts both individually and in any combination, in particular the details illustrated in the drawings, are claimed as being essential to the invention. Modifications in relation to this are familiar to a person skilled in the art.

REFERENCE SIGNS

C1-C5 Capacitors (as a symbolic depiction of an overall capacitance)
M Switching device
M1 First switching device
M2 Second switching device
R1-R4 Resistors (as a symbolic depiction of an overall resistance)
10 Housing
11 Voltage supply
12 Intermediate capacitor
13 Capacitor
14 Inductor
15 Ground connection
16 Second (high-resistance) resistor
17 Third (high-resistance) resistor
18 Connecting line
19 Control apparatus
20 Compensation apparatus

The invention claimed is:

1. An arrangement comprising a heat-emitting first resistor, a control device for switching the first resistor, and a grounded housing or chassis that is at a potential without direct reference to a driving voltage, wherein the first resistor is arranged in a spatial vicinity of the housing or chassis, and has a first and a second terminal, wherein the control device comprises a first switching device and a second switching device, wherein the first switching device, the first resistor and the second switching device are connected in series in said order and thus form a series circuit, wherein a compensation apparatus is provided and configured such that, in the on state of the first resistor, a voltage is present between the first and the second terminal, such that the first terminal is at a first potential and the second terminal is at a second potential, wherein the resistor in the off state is kept at an intermediate potential that lies between the first and the second potential, and wherein the control device is configured to drive the first resistor using pulse width modulation, wherein the first and the second switching device are switched substantially synchronously, wherein the compensation apparatus comprises a high-resistance second resistor, a high-resistance third resistor and a connecting line, wherein the second and the third resistor are connected in series with one another and are connected in parallel with the series circuit formed of the first switching device, the first resistor and the second switching device, wherein the connecting line connects a point between the second and the third resistor to a point between the two switching devices.

2. The arrangement as claimed in claim 1, wherein a resistance of the second resistor and a resistance of the third resistor differ from one another by at most 10%.

3. The arrangement as claimed in claim 1 wherein the first and/or second switching device comprises a transistor based on silicon and/or silicon carbide and/or gallium arsenide.

4. The arrangement as claimed in claim 1, further comprising a support apparatus comprising one or more capacitors in parallel with a second and/or third resistor, for supporting a voltage corresponding to the intermediate potential.

5. The arrangement as claimed in claim 1, further comprising a microcontroller and/or FPGA for controlling the switching of the first and/or second switching device to hone a switching time of the first and second switching device.

6. The arrangement as claimed in claim 1, further comprising a voltage supply.

7. The arrangement as claimed in claim 1, wherein a time lag between a switch-on time of the first switching device and a switch-on time of the second switching device or a time lag between a switch-off time of the first switching device and a switch-off time of the second switching device is less than 20% of a switched-on time of the first switching device.

8. A control method using the arrangement as claimed in claim 1, for switching a heat-emitting first resistor having a first and a second terminal and arranged in a spatial vicinity of a grounded housing or chassis, which is at a potential without direct reference to a driving voltage, wherein the first terminal in an on state of the first resistor is at a first potential and the second terminal in an on state is at a second potential, wherein the resistor in an off state is kept at an intermediate potential, which lies between the first and the second potential, and/or wherein the first resistor is driven using pulse width modulation, wherein a first switching device associated with the first terminal and a second switching device associated with the second terminal are switched synchronously.

9. The control method as claimed in claim 8, wherein a time lag between a switch-on time of the first switching device and a switch-on time of the second switching device and/or a time lag between a switch-off time of the first switching device and a switch-off time of the second switching device is less than 20% of a switched-on time of the first switching device.

10. An electrical heating apparatus comprising an arrangement as claimed in claim 1.

11. The arrangement as claimed in claim 1, wherein a resistance of the second resistor and a resistance of the third resistor are substantially the same.

12. The arrangement as claimed in claim 3 wherein the first and/or second switching device comprises a MOSFET or IGBT.

13. The arrangement as claimed in claim 1, wherein a voltage supply is a DC source.

14. The arrangement as claimed in claim 1, wherein a time lag between a switch-on time of the first switching device and a switch-on time of the second switching device or a time lag between a switch-off time of the first switching device and a switch-off time of the second switching device is less than 5% of a switched-on time of the first switching device.

15. The control method of claim 8 wherein the intermediate potential is at least approximately half of a supply voltage.

16. An electrical heating apparatus configured perform the control method of claim 8.

* * * * *